US006098538A

United States Patent [19]

Hamu

[11] Patent Number: 6,098,538

[45] **Date of Patent: *Aug. 8, 2000**

[54] REGISTRATION SYSTEM FOR SCREEN PRINTING

[75] Inventor: Alan J. Hamu, Huntington Beach, Calif.

[73] Assignee: Kaino J. Hamu, Huntington Beach, Calif.

[ * ] Notice: This patent is subject to a terminal disclaimer.

[21] Appl. No.: 09/153,100

[22] Filed: Sep. 14, 1998

Related U.S. Application Data

[63] Continuation of application No. 08/316,229, Sep. 30, 1994, Pat. No. 5,813,328.

[51] Int. Cl.[7] ..... B05C 17/06

[52] U.S. Cl. ..... 101/126; 101/DIG. 36

[58] Field of Search ..... 101/114, 115, 101/116, 123, 126, 127.1, 128.1, DIG. 36

[56] References Cited

U.S. PATENT DOCUMENTS

| | | | |
|---|---|---|---|
| 4,463,673 | 8/1984 | Moore | 101/DIG. 36 |
| 4,723,487 | 2/1988 | Richardson | 101/126 |
| 4,846,058 | 7/1989 | Farris | 101/123 |
| 4,920,878 | 5/1990 | Harpold et al. | 101/126 |
| 5,127,321 | 7/1992 | Proffer | 101/126 |
| 5,445,075 | 8/1995 | Panipinto | 101/127.1 |
| 5,483,882 | 1/1996 | Jaffa | 101/127.1 |
| 5,582,104 | 12/1996 | Best et al. | 101/126 |
| 5,813,328 | 9/1998 | Hamu | 101/127.1 |

*Primary Examiner*—Eugene Eickholt
*Attorney, Agent, or Firm*—Boniard I. Brown

[57] ABSTRACT

The several screen frames of a multistation screen printing machine, such as a carousel screen printer, having multiple work supports movable to the printer stations in succession to effect successive printing of screen images on work pieces fixed to the supports are precisely registered with the work supports by providing each frame with registration features precisely located relative to the screen image on the frame, providing a selected work support with registration features precisely located relative to the printing position of a work piece on the selected support, effecting movement of the selected work support to the print stations in succession, adjusting the corresponding screen frame to directly align its registration features with the registration features on the selected work support, and securing the frame in fixed position.

9 Claims, 9 Drawing Sheets

REGISTRATION SYSTEM FOR SCREEN PRINTING

This application is a continuation of U.S. application Ser. No. 08/316,229, filed Sep. 30, 1994 and now U.S. Pat. No. 5,813,328.

BACKGROUND OF THE INVENTION

1. Field of the Invention

This invention relates generally to the silk screen printing art and more particularly to an improved registration method and apparatus for registering, that is aligning, the screen image(s) to be printed relative to the workpieces to be imprinted with such screen image(s).

2. Discussion of the Prior Art

The printing procedure, commonly referred to as silk screen printing, is very old and well known and utilized to imprint both monochromatic and multicolor images on a vast assortment of articles. A wide variety of screen printing devices have been devised ranging from a simple frame for holding a printing screen, a support for the work piece to be imprinted, and a manual squeegee for wiping a printing ink across the screen to automatic multistation screen printing machines for high speed printing multicolor images on workpieces.

Following is a list of patents disclosing screen printers and related registration systems:

U.S. Pat. No. 3,943,851 dated Mar. 16, 1976, to Inada discloses a system for aligning a sheet containing an image to be printed relative to a printing screen on which the image is to be reproduced.

U.S. Pat. No. 4,463,673 dated Aug. 7, 1984, to Moore discloses a system for aligning a first sheet relative to a second sheet containing an image to be printed on the first sheet.

U.S. Pat. No. 4,669,378 dated Jun. 2, 1987, to Lee discloses a multiple station carousel screen printer including alignment gates at the printing stations for angularly aligning printing screens at the stations with platens supporting workpieces to be printed.

U.S. Pat. No. 4,846,058 dated Jul. 11, 1989, to Farris discloses a system for screen printing a sequence of accurately registered images involving imprinting test images on a transparent register plate to check image registration.

U.S. Pat. No. 4,949,635 dated Aug. 21, 1990, to Padula discloses a multicolor carousel screen printer having screen frame supports which are adjustable to register the printing screens relative to the workpieces to be imprinted.

U.S. Pat. No. 4,993,166 dated Feb. 19, 1991, to Bradley discloses means for adjusting a printing screen frame relative to a screen printer pin bar.

U.S. Pat. No. 5,127,321 dated Jul. 7, 1992, to Proffer discloses a system for pre-registering a set of related film positives relative to one another and a carousel screen printer in which each screen holder and each print head have coacting means for aligning the holder and print head about the rotation axis of the printer turret.

U.S. Pat. No. 5,188,026 dated Feb. 23, 1993, to Fuqua et al and U.S. Pat. No. 5,226,362 dated Jul. 13, 1993, to Iaccino et al disclose multistation carousel screen printers having a calibration pallet rotatable to the print stations in succession, and means at each station for indirectly pin registering a printing screen at each station to the calibration pallet by first pin-registering a pair of alignment brackets at the respective station to the calibration pallet and thereafter pin-registering a screen frame mounting the printing screen to the alignment brackets.

U.S. Pat. No. 5,239,923 dated Aug. 31, 1993, to Belcher et al discloses a multistation screen printer having ball and socket means at each station for effecting screen/pallet registration.

The present invention is concerned primarily with, and will be described in the context of a multistation, multicolor printing machine, specifically a so-called carousel screen printer. It will become evident as the description proceeds, however, that the registration means of the invention may be used on other types of screen printers.

Simply stated, a carousel screen printer comprises a number of print stations spaced circumferentially about a vertical axis, a rotary turret mounting an equal number of work supports, commonly called pallets, also spaced circumferentially about the axis, and means for rotating the turret to align the pallets with the print stations in succession. Each pallet is elevated to and lowered from a raised printing position at each station. Each print station includes a holder supporting a screen frame mounting a printing screen having blocked and unblocked screen apertures or pores defining an image to be printed. Each print station also includes a so-called flood bar movable back and forth across the upper side of the screen for spreading a printing ink across the screen and forcing the ink through the open screen pores. The images on the several printing screens define different portions or color separations of a completed multicolor image to be printed.

Operation of a carousel screen printer involves (a) mounting a workpiece to be imprinted on each work pallet, (b) rotating the printer turret stepwise through its successive printing positions to rotate the work pallets to the print stations in succession, (c) elevating the pallets at the successive print stations to their printing positions in which the work pieces on the pallets contact the undersides of the respective printing screens, and (d) driving the flood bars back and forth across the upper sides of their respective screens while the pallets are in their elevated printing positions to imprint the respective screen images on the work pieces. The several screen images are thereby imprinted in succession on each work piece. Each of these several screen images is printed in a different single color. The shapes of the several screen images and the different colors in which these images are successively imprinted on each work piece are selected to produce on each workpiece a desired composite multicolor image.

Successful screen printing of such a composite multicolor image requires very precise screen image-to-work piece registration in order to achieve the precise registration or alignment of the several color separation images successively imprinted on each work piece. A variety of registration systems for this purpose have been devised. These prior registration systems range from those in which registration of the successive printed images is accomplished by visual observation of the printed images and manual adjustment of each frame as necessary to achieve precise image registration, as in the Farris U.S. Pat. No. 4,846,058, to those registration systems which involve positive mechanical registration, as in the Fuqua U.S. Pat. No. 5,188,026 and Iaccino et al U.S. Pat. No. 5,226,362. The prior visual/manual registration procedures are very time consuming and require the services of a skilled technician and hence are quite costly. The Fuqua and Iaccino et al mechanical registration systems are two stage registration systems which involve a two step registration procedure at each print station, as discussed below, and hence are also relatively time consuming and costly.

The precise image registration essential to multicolor screen printing involves three basic requirements. These requirements are: (1) precise registration (i.e. precise predetermined location or alignment) of each screen image relative to its respective screen frame, (2) precise registration of each screen frame relative to each work pallet, and (3) precise registration of each work piece relative to its work pallet, that is proper placement of each work piece of its work pallet in precise alignment with the pallet.

In the Fuqua and Iaccino et al screen printers, these three requirements are accomplished by utilization of a vacuum table having upstanding registration pins, a calibration pallet having registration holes which replaces one work pallet of the printer during the registration procedure and its rotated to the printer print stations in succession, a screen frame at each print station having registration holes, and screen frame holders at each print station mounting adjustable alignment brackets having registration holes. Image registration involves the following registration procedure.

A film positive transparency bearing a color separation image to be printed at each print station is prepared and secured to the vacuum table with the film positive image located in a predetermined position relative to the registration pins on the table. A screen frame mounting a photoresist-coated printing screen is placed on the vacuum table over the film positive with the table registration pins extending through the frame registration holes to locate the frame, and hence the frame registration holes, in a predetermined registered position relative to the film positive image. The film positive is then secured to the frame, after which the frame and film positive are removed from the table, exposed, and processed to produce on the screen a negative image corresponding to the film positive image and registered with, that is located in a predetermined registered position relative to, the frame. This part of the registration procedure is repeated for each screen frame of the printer and provides a plurality of screen frames bearing registered color separation screen images to be sequentially imprinted on each work piece.

The remainder of the Fuqua/Iaccino registration procedure involves indirect registration of the screen frame at each print station with the calibration pallet. This is accomplished by initially aligning and then inserting registration pins through the registration holes in the adjustable print station alignment brackets and the registration holes in the calibration pallet to pin-register the alignment brackets with the calibration pallet. The alignment brackets are then fixed in their registered positions. The final step of the Fuqua/Iaccino registration procedure involves aligning and then inserting the registration pins through the registration holes in the respective screen frame and the fixed alignment brackets to pin-register the frame with the alignment brackets.

This latter part of the registration procedure is repeated at each print station. The calibration pallet is then replaced by a normal work pallet, the work pieces to be printed are fixed in the proper registered positions on the several work pallets, and the screen printer is operated to print the successive color separation images on the workpieces. Since the calibration pallet and all the printer work pallets occupy the same, though circumferentially spaced, positions on the printer turret, the Fuqua/Iaccino registration procedure is stated to be effective to register work screen frame image with each work pallet and hence with the work piece on the pallet.

BRIEF DESCRIPTION OF THE INVENTION

This invention provides an improved image registration method and system for screen printers. The improved image registration invention is particularly designed for use in a multicolor carousel printer and will be described in this context. It will be clear from the ensuing description, however, that the invention may also be used on other screen printers.

According to one aspect of this invention, there is provided a screen printer having a printing mode and an image registration mode. The printer includes a screen frame, a print station including a screen frame holder for supporting the screen frame, a work support, and means for effecting relative movement of the print station and work support to and from a printing position wherein the work support is aligned in printing relation with the print station. The screen frame mounts a printing screen bearing a screen image which is registered with, that is located in a predetermined position relative to, the frame. The screen frame holder at the print station supports the screen frame for edgewise adjustment of the frame relative to the print station and includes means for releasably securing the frame in fixed position relative to the station.

In its registration mode, the printer further includes positive registration means directly engagable between the screen frame and the work support to directly register the screen frame with, that is locate the frame in a predetermined registered position relative to, the work support. The registration means provides registration references on the frame and work support, and in the preferred inventive embodiments described herein, comprises registration pins engagable between the work support and the screen frame. In one described inventive embodiment, the work support comprises a work pallet, and the registration pins are engagable with the screen frame and a pallet attachment tool removably secured to the pallet. In another described embodiment, the registration means includes a pallet replacement tool which replaces the work pallet during the registration. The registration pins are engagable with this pallet replacement tool and the screen frame.

In the image registration mode of the printer, the work support is aligned with the print station. The screen frame is placed in the frame holder of the print station and directly registered with, that is directly aligned in a predetermined position relative to, the work support by manual adjustment of the frame to a position which permits engagement of the engagable registration means on the frame and work support. The screen frame is then fixed in its registered position relative to the screen holder, and the registration means are rendered inoperative.

During operation of the printer in its printing mode, a work piece to be printed is fixed on the work support in the proper registered position relative to the work support. The work support and screen frame are moved toward one another to place the work piece in printing contact with the underside of the printing screen, after which a printing ink is spread across the upper side of the screen and forced through the open pores of the screen to imprint the screen image on the work piece. Since the screen image is registered with the screen frame and the work piece is registered with the work support, the above direct registration of the frame with the work support by engagement of their engagable registration means effects registration of the screen image with the work piece and thereby precise printing of the screen image in the proper position on the work piece.

According to another of its aspects, the invention provides a multicolor printer for printing a series of color separation images in succession on each of a plurality of workplaces with the several images on each workpiece precisely registered relative to one another to form a composite multicolor image. The preferred multicolor printer described herein is a carousel printer having a turret rotatable on a generally vertical rotation axis, a number of print heads located at print stations, respectively, circumferentially spaced about the axis, and screen frames on the print heads, respectively, mounting printing screens bearing screen images corresponding to the different color separation images to be sequentially printed on each work piece. Each print head has a screen frame holder supporting the respective screen frame for edgewise adjustment of the frame relative to the print head, and a flood bar which is movable back and forth across the upper side of the respective frame screen. The printer turret includes a number of work supports equal in number to the print stations and spaced circumferentially about the turret. Each work support includes a radial arm on the turret and a work pallet on the outer end of the arm. The printer has a normal printing mode and a registration mode, and includes registration means associated with each screen frame and one selected work support for directly registering each frame with the selected work support in the registration mode.

During operation of the preferred multicolor printer in its printing mode, a work piece to be printed is fixed to each work pallet of the printer. The printer turret is rotated stepwise to locate the work pallets at the print stations in succession while the work supports are in lower retracted positions. The work supports are elevated to raised printing positions at each station to press the work pieces on their work pallets against the underside of the printing screens on the adjacent screen frames during movement of the ink flood bars across the upper sides of the screens to imprint the screen images on the work pieces. The work supports are then lowered and rotated to the next print stations where the printing procedure is repeated.

In the image registration mode of the preferred multicolor printer, the screen frame at each print station is directly registered with the selected work support of the printer by rotating the selected work support to the print stations in succession, elevating the selected work support to its raised position at each station, and effecting direct engagement of the printer registration means with the respective screen frame and the selected work support to precisely directly register the screen frame with the work support. The registered screen frame is then fixed in its registered position to its screen holder, after which the selected work support is rotated to the next print station to register its screen frame.

In one described embodiment of the multicolor printer, the registration means includes registration pins engagable with each screen frame and a pallet attachment tool removably secured to the work pallet of the selected work support. In another described embodiment, the registration means includes registration pins engagable with each screen frame and a pallet replacement tool which replaces the work pallet of the selected work support during registration.

DESCRIPTION OF THE PREFERRED EMBODIMENTS

Figure 1:
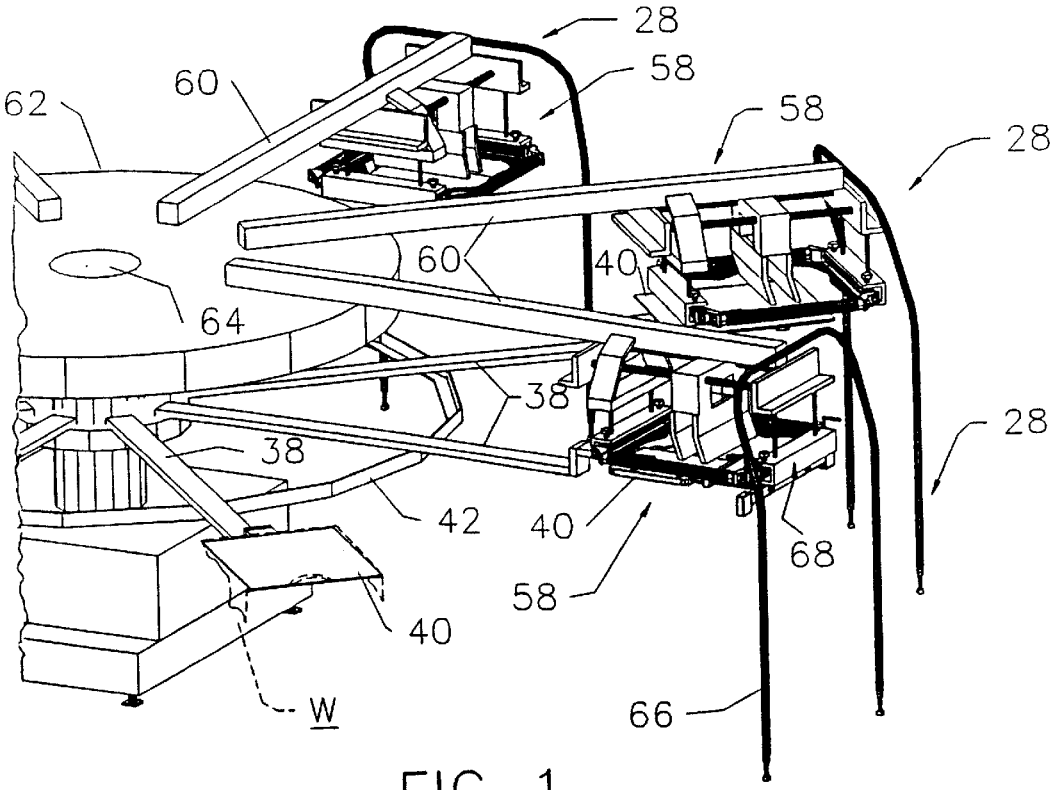
FIG. 1 is a fragmentary perspective view of a carousel multicolor screen printer embodying the improved direct screen frame-to-work pallet registration system according to the invention.

Turning now to these drawings and first to FIGS. 1–5, there is illustrated a screen printer 20 including improved registration means according to this invention. Except for the improved registration means of the invention, the printer 20 is conventional and hence need be described only in sufficient detail to enable a full and complete understanding of the invention. With this in mind, the illustrated screen printer is a carousel multicolor printer including a base 22 rotatably supporting a rotary turret 24 which turns on a vertical rotation axis 26, and a plurality of print stations 28 spaced circumferentially about the turret. Within the base are means (not shown) for driving the turret 24 in stepwise rotation about its rotation axis 26.

Turret 24 includes a central tubular support column 30 coaxial with the rotation axis 26 and rotatably supported at its lower end on the base 22 for rotation on the rotation axis. The turret driving means within the base are drivably coupled to the lower end of the column for driving the column in the later described stepwise rotation. Mounted on the column 30 for rotation with and axial movement along the column is a relatively rigid work support structure or work support table 32. Within the base 22 and turret 24 are means (not shown) for moving this work support table up and down along the column 30 in timed relation to stepwise rotation of the column, as explained later. The work support table is movable vertically along the column between its lower solid line retracted position and its upper broken line printing position in FIG. 2.

The work support table 32 includes a central collar 34 slidable along and rotatable with the column 30, and a plurality of radial work supports or support arms 38 rigidly secured at their inner ends to the collar 34 and mounting work support pallets 40 at their outer ends. The several radial work support arms 38 are rigidly joined by a connecting ring 42 concentric with the collar 34. As explained later, during operation of the printer 20, the work support table 32 is moved up and down along the column 30 in timed relation to stepwise rotation of the column to move the work support pallets 40 between their solid line lower retracted positions and broken line upper printing positions in FIG. 2.

Figure 2:
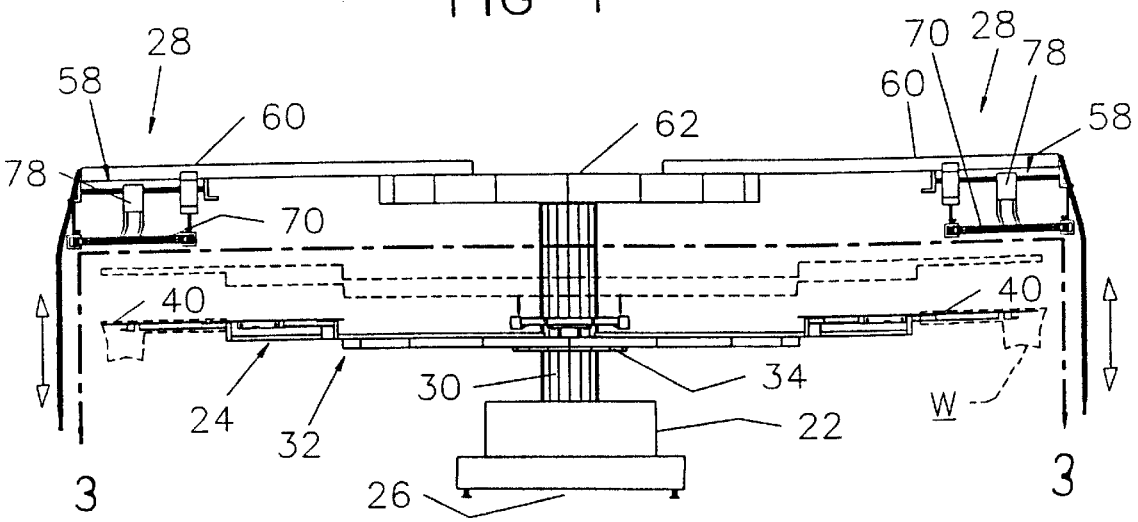
FIG. 2 is a side elevation of the printer on reduced scale.
Figure 3:
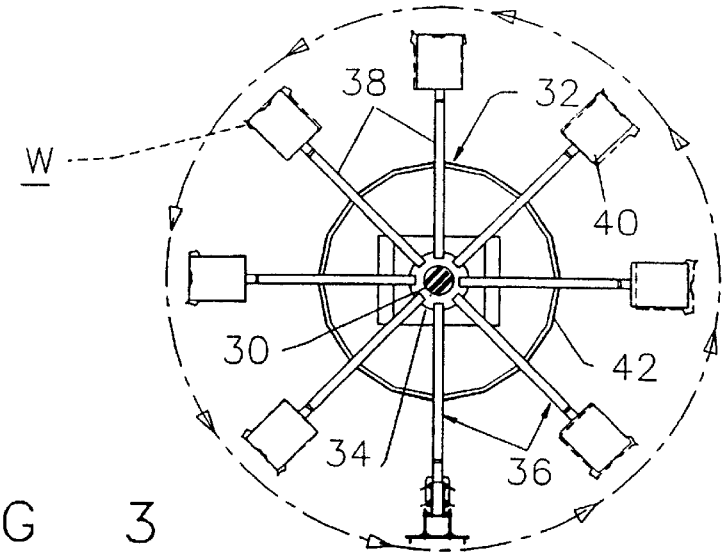
FIG. 3 is a view of the printer taken on line 3—3 in FIG. 2.
Figure 4:
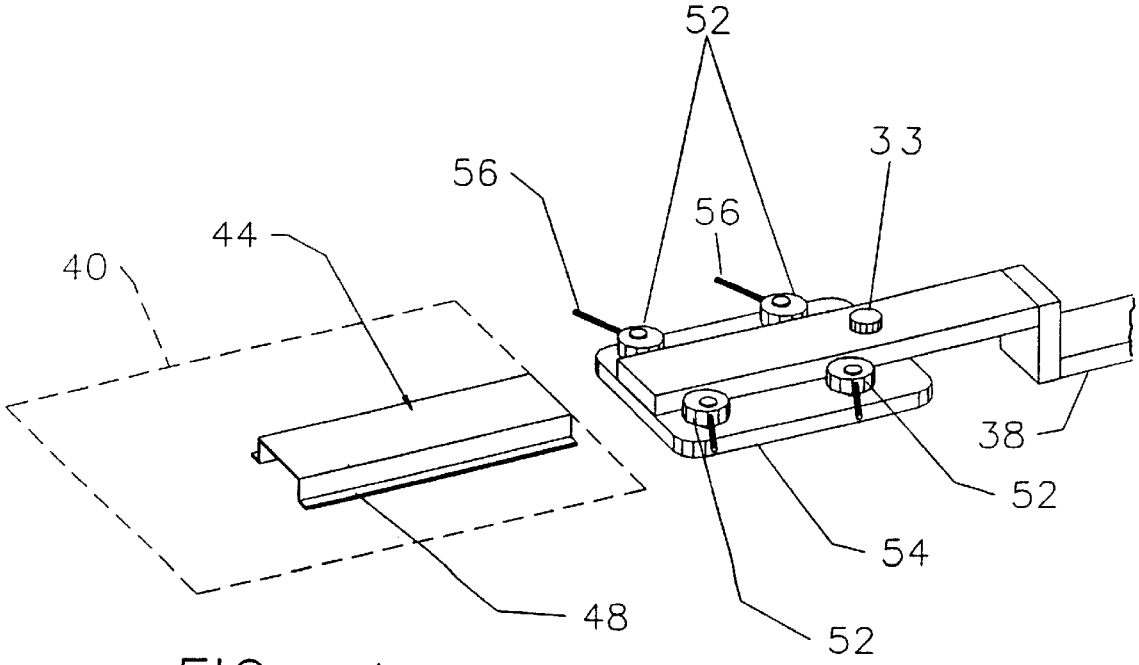
FIGS. 4 and 5 are fragmentary perspective views illustrating the manner in which work support pallets of the printer are secured to pallet support arms.
Figure 5:
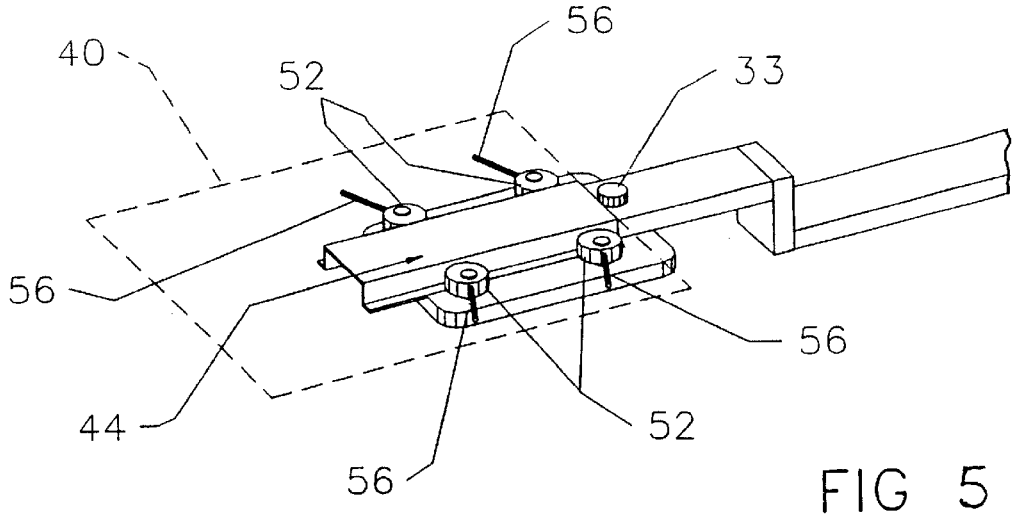

As shown in FIGS. 2 and 3, the several work support pallets 40 are located in a common plane transverse to the turret rotation axis 26 and are equally radially spaced from the axis. The pallets are removably secured to their respective support arms 38. To this end, each pallet 40 has a channel 44 (FIGS. 4 and 5) rigidly secured to its underside and aligned with the radial centerline of the pallet. The side walls 46 of this channel have out turned flanges 48 along their lower edges. The channel of each work pallet is sized to slide over the radially outer free end of its support arm 38 in the manner shown in FIG. 5. The supports arms 38 have limit stops 33 engagable by their respective pallet channel 44 to locate the several pallets at equal radial distances from the rotation axis 26.

Each work pallet 40 is releasably secured to its support arm 38 by rotary eccentric clamps 52. These clamps are rotatably mounted on the upper side of a support plate 54 rigidly secured to the underside of the respective support arm at the radially outer end of the arm. When the clamps 52 are released, they permit the respective pallet 40 to slide onto and from the respective pallet support arm 38. The clamps have arms 56 by which they may be rotated to clamp and release the pallets.

Each print station 28 includes a print head 58 mounted on the outer end of a radial support arm 60 having a radially inner end rigidly joined to a center support plate 62 above the upper end of the rotary turret column 30. Plate 62 is rigidly joined to the upper end of a support shaft 64 which extends downwardly through the column 30 to and is rigidly secured at its lower end to the base 22. The outer ends of the print head support arms 60 are supported on stands 66 which rest on the floor.

Each print head 58 includes a holder 68 for supporting a rectangular screen frame 70 above and parallel to the common plane of the work pallets 40. Each printing frame 70 mounts a rectangular printing screen 72 bearing an image (not shown) to be printed. The particular screen frame shown is a roller frame like that described in U.S. Pat. No. 5,018,442. This patented screen frame includes rollers 74 forming the sides and ends of the frame and corner brackets 76 joining and rotatably supporting the adjacent roller ends. The edges of the printing screen 72 are attached to the rollers 74 which are then rotated to stretch the screen edgewise to the proper tension and then secured against rotation to maintain the screen tension. Each print head 58 also has a so-called flood bar 78 including squeegees 80. During printer operation, the flood bar 78 is driven back and forth across the upper side of the printing screen to spread printing ink across the screen and force the ink through open screen pores.

As described to this point, the printer 20 is conventional and operates in the well known way to print composite multicolor images on work pieces W by successively imprinting precisely registered color separation images on each work piece. Briefly the printer operation is as follows. A work piece is fixed to the upper side of each work pallet 40. Screen frames 70 mounting printing screen 72 bearing the images, respectively, to be successively imprinted on each work piece are mounted in the screen holders 68. The turret 24 is driven in stepwise rotation to rotate the work pallets 40 to the print stations 28 in succession while the turret work table 32 is in its lower solid line retracted position of FIG. 2. Each turret position in which the work pallets are thus aligned with the print stations is referred to herein as a printing position of the turret. While at each printing position, the turret work table 32 is elevated to its upper broken line printing position in FIG. 2 to press the work pieces W against the undersides of the printing screens 72. The flood bars 78 are then driven back and forth across the upper sides of the screens to imprint the screen images on the work pieces. The turret work table is then lowered to its retracted position and rotated to the next print stations where the above printing operation is repeated.

This invention provides improved registration means 82 for mechanically registering each screen frame 70 directly with the work pallets 40 to precisely register the images on the frame screens 72 with the work pieces W on the pallets. It is important to note here that the images on printing screens 72 used in the printer 20 will have been registered with their respective screen frames on a vacuum table in the manner explained earlier or in any other convenient way. Similarly, the work pieces to be printed will have been fixed on the work pallets 40 in the proper printing positions relative to the pallets so that direct registration of the screen frames with the pallets is effective to register the screen images with the work pieces.

The improved registration means 82 of the invention comprises screen frame supporting means 84 embodied in the frame holders 68 removably supporting the screen frames 70 for edgewise adjustment relive to their respective print heads 58, and frame securing means 86 for releasably securing the frames in fixed position relative to the print heads. The registration means 82 further includes a registration device 88 mounted on a selected turret work support or support arm 38 for rotation with the turret 24 to the print stations 28 in succession, and alignment means 90 directly engagable between the screen frame 70 at each print station 28 and the registration device 88 when the device is situated at the respective print station for registering the frame with, i.e. aligning the frame in a predetermined registered position relative to, the registration device.

In the registration mode of the printer 20, the turret 24 is driven in stepwise rotation with the work table 32 in its lower retracted position to locate the registration device 88 at the print stations 28 in succession. The screen frame 70 at each print station is adjusted edgewise relative to its supporting means 84 to effect direct engagement of the alignment means 90 with both the frame and the registration device and thereby direct registration of the frame with the registration device. As mentioned earlier, all of the work pallets 40 are located in the same (though circumferentially spaced) relative positions with respect to the turret rotation axis 26. The registration device 88, in turn, is mounted on the selected work support arm 38 in a position such that registration of each screen frame with the registration device is effective to register the respective frame with all the work pallets 40. Each registered frame is fixed in its registered position by tightening its frame securing means 86. The turret 24 is then rotated to the next print station where the above alignment procedure is repeated.

Referring now in more detail to the illustrated printer, the screen frame supporting means 84 of each print head frame holder 68 comprise a pair of channels 92 suspended by hangers 94 from overhead members 96 rigidly secured to the respective print head support arm 60. The two frame support channels 92 extend transverse to the respective support arm 60 in a common plane above and parallel to the plane of the turret work table 32. The channels open toward one another and are spaced to receive and vertically support the ends of a screen frame 70 in the common plane of the channels. The channels are spaced and sized to support the screen frames for edgewise adjustment relative to the respective print head 58 and in the common plane of the screen support channels to effect registration of the frame relative to the work pallets 40 in the manner described below. The frame securing means 86 of the frame holders 68 comprise clamp screws threaded in the upper flanges of the frame support channels 92.

Figure 7:
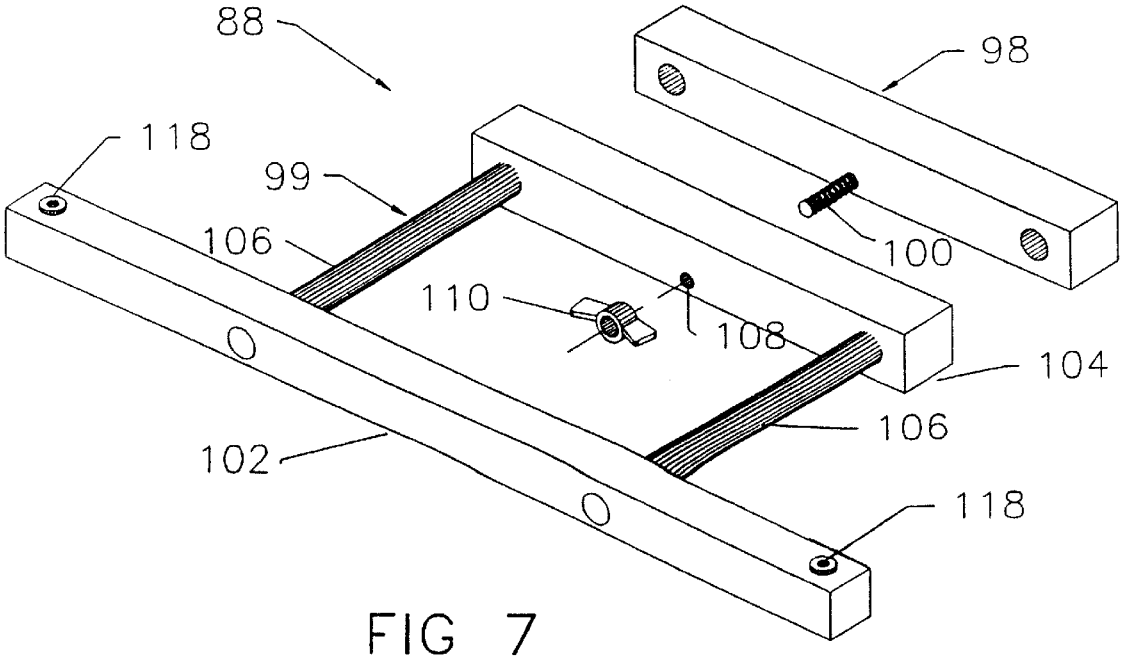
FIG. 7 is an enlarged perspective view of the pallet attachment tool shown in FIG. 6.
Figure 8:
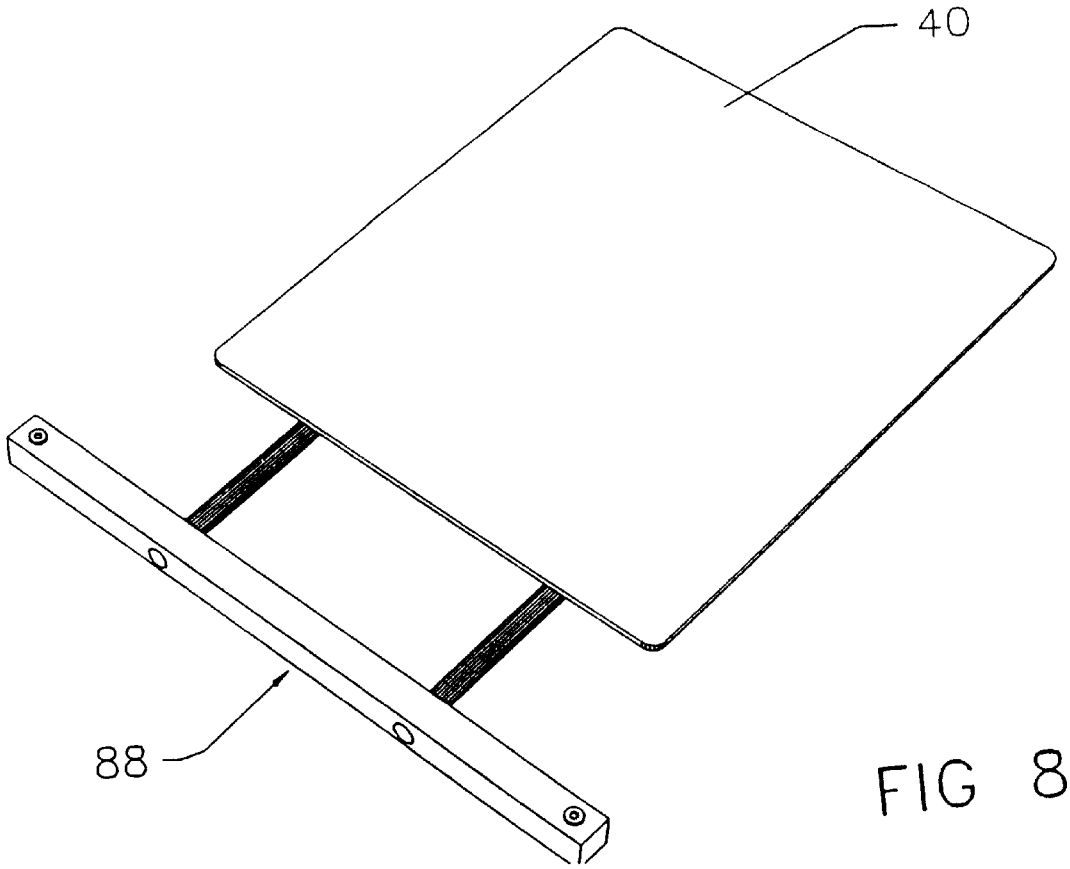
FIGS. 8 and 9 are perspective views of the upper and lower sides, respectively, of the printer work pallet and pallet attachment tool in FIG. 7.
Figure 9:
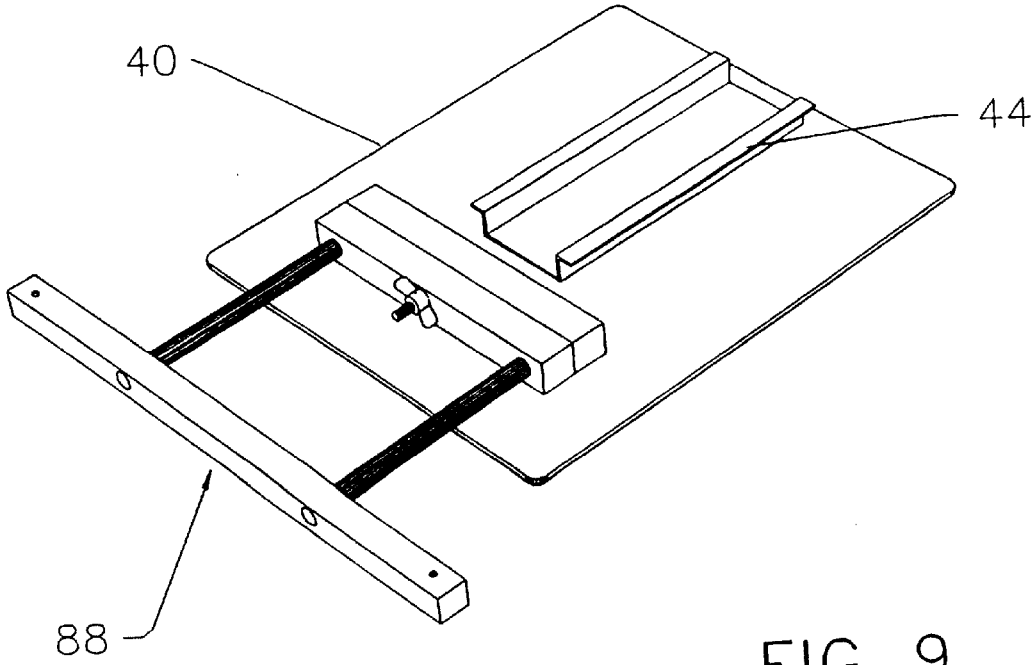

In the particular registration means 82 illustrated in FIGS. 1–12, the registration device 88 is a pallet attachment tool to be secured to a selected one of the printer work pallets 40. Referring to FIGS. 7–9, the pallet attachment tool 88 comprises normally rear and front parts 98, 99. The rear part 98 is a receiver or mounting block which is adapted to be secured to the underside of one printer work pallet 40. Extending from the normally front face of the block is a screw 100. The removable front part 99 of the pallet attachment tool 88 comprises normally front and rear bars 102, 104 rigidly joined by connecting rods 106. The rear bar 104 contains a hole 108 for receiving the mounting block screw 100. The rear mounting block 98 and front attachment part are joined by placing the rear bar 104 of the front part against the front face of the mounting block with the mounting block screw 100 extending through the hole 108 in the rear bar and then threading a thumb screw 110 or the like on the screw to hold the mounting block and front part firmly together.

The mounting block 98 and the rear bar 104 of the front attachment part 99 have approximately equal lengths somewhat less than the width of the printer work pallets 40. The length of the front attachment bar 102 is somewhat greater than the lengths of the rear bar and mounting block and the width of the work pallet.

The pallet attachment tool 88 is mounted on the underside of the selected printer work pallet 40 in the position shown in FIGS. 8 and 9. This mounting is accomplished by either removably or permanently securing the pallet attachment tool mounting block 98 to the underside of the work pallet in any convenient way, as by tape, fasteners, or welds. As shown in FIG. 9, the mounting block is positioned a distance behind the front edge of the pallet with the length of the block transverse to the fore and aft direction of the pallet. The front bar 102 of the attachment tool is positioned relative to the work pallet as discussed below.

The alignment means 90 of the improved registration means 82 comprises registration pins 114 insertable through registration holes 116 and 118 in each screen frame 70 and the pallet attachment tool 88, respectively. These registration holes may be provided by hardened bushings and are sized to receive the registration pins with a sliding fit. As shown best in FIG. 6, the registration holes 116 in each screen frame 70 extend through the two corner brackets 76 at one end of the frame with the axes of the holes transverse to the plane of the frame. This end of each frame is hereafter referred to as its front end. Each frame is positioned with its front end (i.e. the frame end containing the frame registration holes 1116) located at the front end of the respective frame support, that is the right hand radially outer end of the frame support in FIG. 6. The registration holes 118 in the pallet attachment tool 88 extend through the ends of the front attachment bar 102 with the axes of the holes transverse to the plane of the pallet attachment tool. The spacing between the pallet attachment registration holes 118 equals the spacing between the frame registration holes 116.

It will be recalled from the earlier description that operation of the printer 20 in its normal printing mode involves rotation of the work pallets 40 to the print stations 28 in succession by stepwise rotation of the printer turret 24 to its printing positions in succession while the work pallets 40 are in their lower solid line retracted positions of FIG. 2. The pallets are elevated at each print station to their upper broken line printing positions of FIG. 2 against the undersides of the adjacent printing screens 72 and then lowered to their lower retracted position for rotation to the next stations. Prior to operation of the printer in this normal printing mode, the printer is operated in a registration mode during which the improved registration means 82 of the invention are utilized in the manner described below to register the printing frame 70 at each print station 28 with all the work pallets 40.

Figure 6:
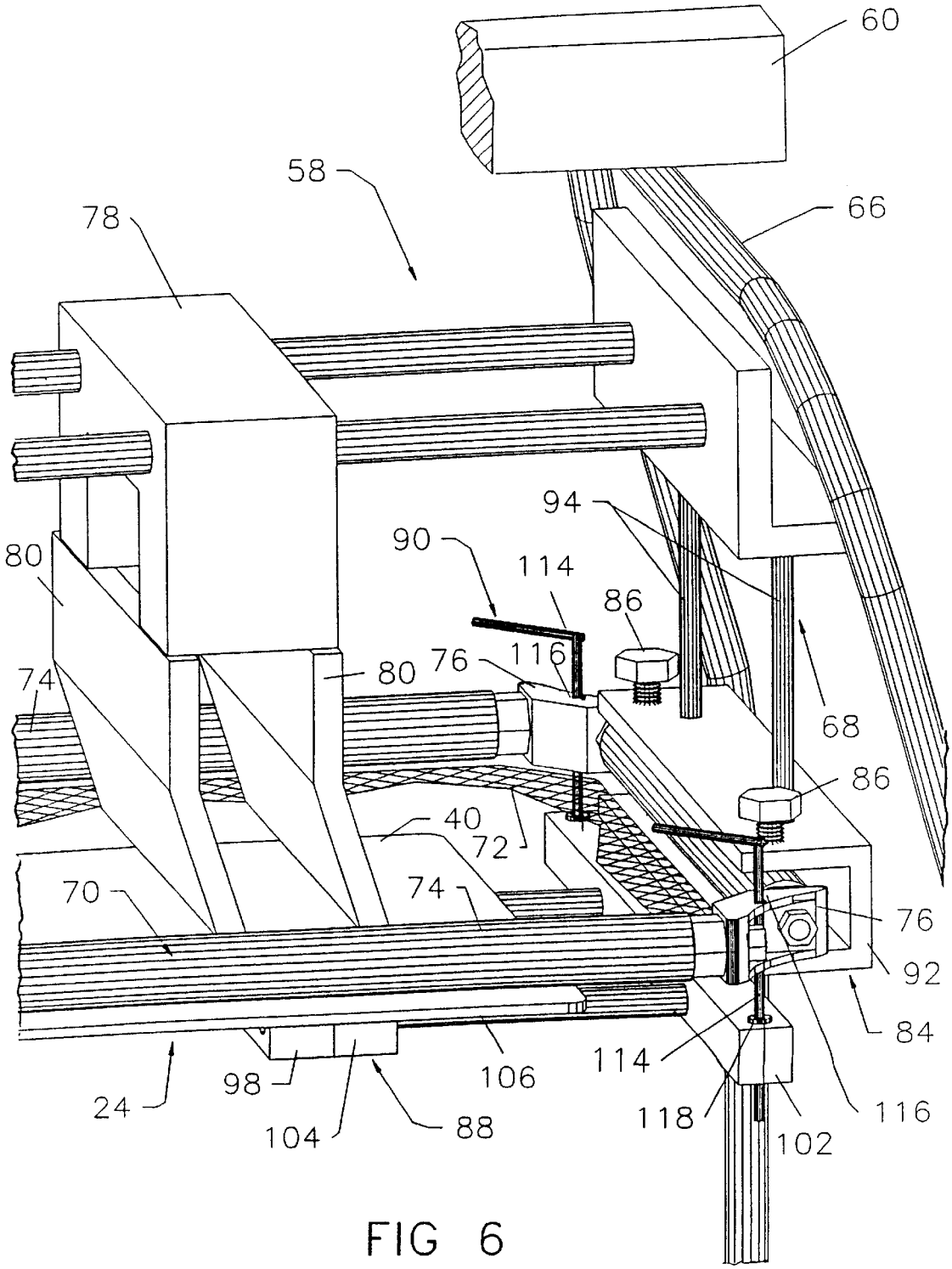
FIG. 6 is an enlarged fragmentary perspective view of one print station of the printer showing a printer work pallet at the station mounting a pallet attachment tool of this invention.
Figure 10:
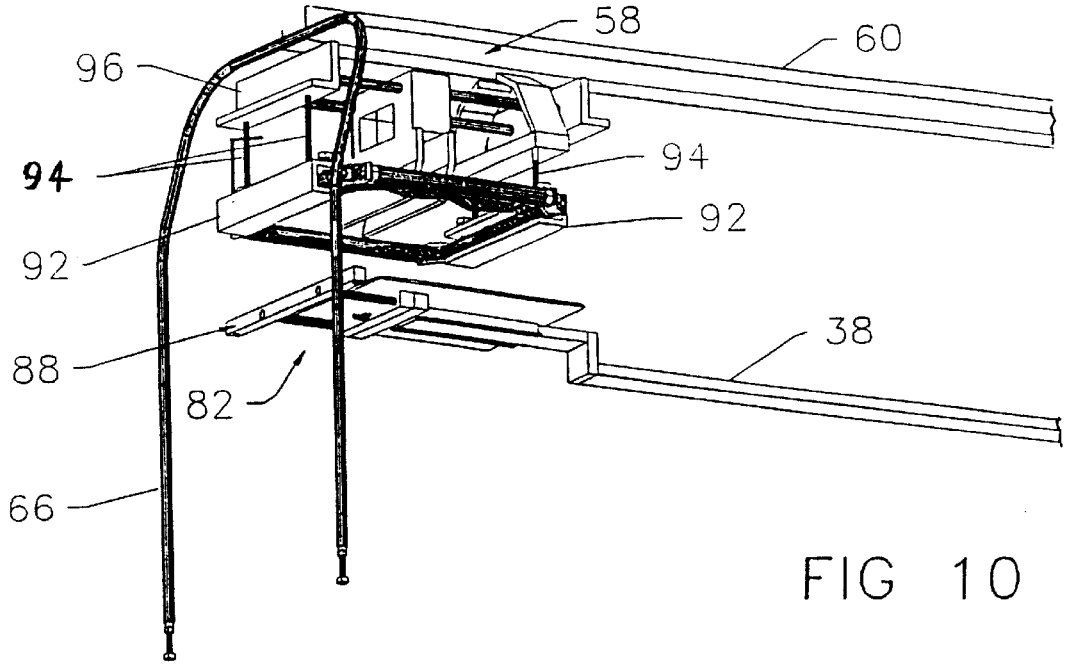
FIG. 10 is a perspective view of one print station of the screen printer illustrating the pallet attachment tool of FIGS. 7–9 in an initial position at a print station of the printer.
Figure 11:
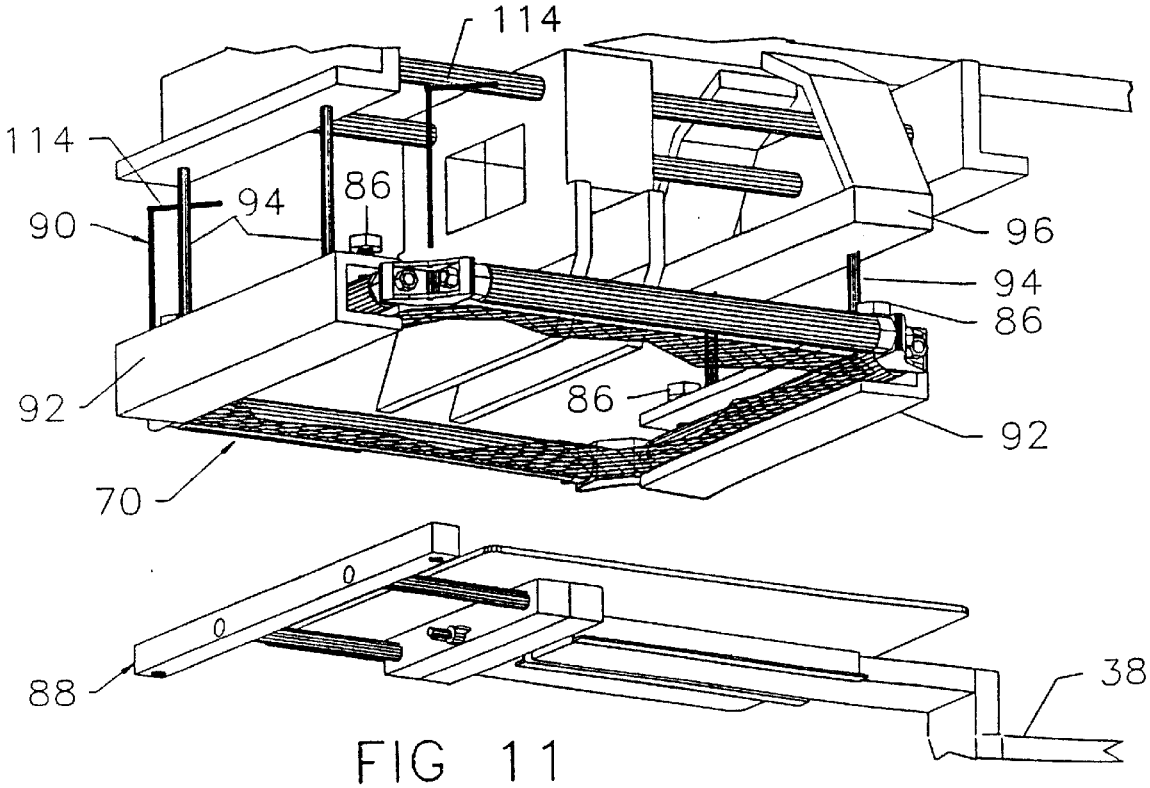
FIG. 11 is a fragmentary enlargement of FIG. 10.
Figure 12:
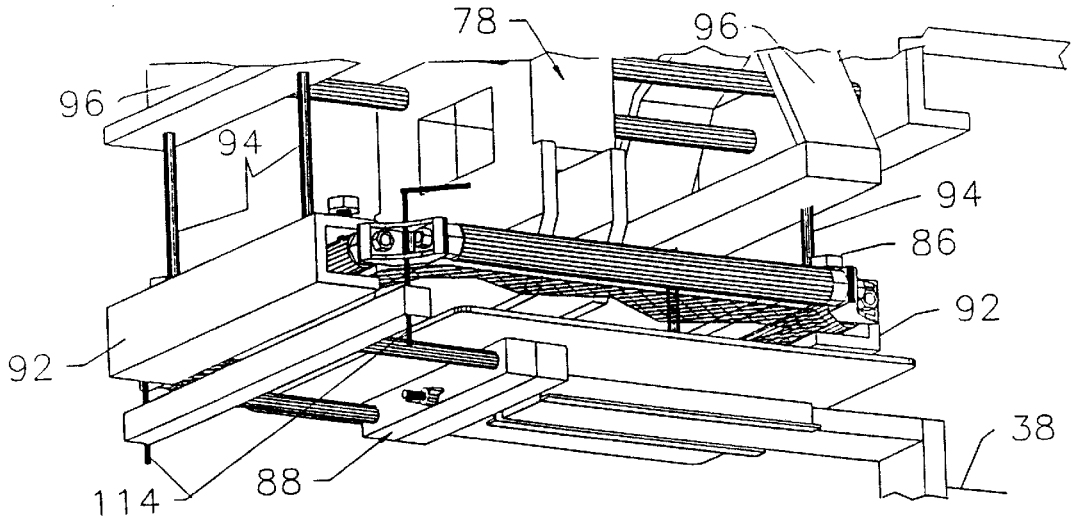
FIG. 12 is a view similar to FIG. 11, illustrating the manner in which the pallet attachment tool is used to register the screen frame with the printer work pallets.

The printer is conditioned for operation in its registration mode by mounting the pallet attachment tool 88 on the underside of a selected work pallet 40 in the manner shown in FIGS. 8 and 9. The printer turret 24 is then rotated stepwise to its printing positions in succession, and the turret work table 32 is elevated while in each printing position, all in essentially the same way as in normal printing operation of the printer. In contrast to the purpose of this turret movement during normal printer operation, however, the purpose of the turret movement in the registration mode is to locate the selected work pallet 40 and its pallet attachment tool 88 in registration relation to each screen frame 70. Thus, in the registration mode, the selected work pallet 40 and the pallet attachment tool are rotated to the print stations in succession while the pallet and attachment are in their lower retracted positions, as shown in FIGS. 10 and 11. The selected pallet and pallet attachment tool are elevated at each print station to the registration position of FIGS. 6 and 12. In this registration position, the pallet is disposed in close proximity to the underside of the respective printing screen 72. The pallet attachment tool 88 is disposed in registration relation to the respective screen frame 70, wherein the front bar 102 of the attachment is located below the front end of the respective screen frame support 84. The flood bars 78 are not moved across the printing screens 72 in the registration mode.

the selected work pallet 40 and its pallet attachment tool 88 are held in their elevated registration position at each print station for a period of time during which the respective screen frame 70 is adjusted edgewise in its holder 68 to align the registration holes 116 in the frame with the registration holes 118 in the pallet attachment tool. The registration pins 114 are then inserted through the aligned frame and attachment holes, as shown in FIGS. 6 and 12 to precisely positively register, that is precisely positively align, the frame with the pallet attachment tool. It will be observed in FIGS. 6 and 12 that the front frame support channel 92 is sized to provide ample clearance for insertion of the registration pins through the aligned registration holes. This registration of the screen frame with the pallet attachment tool also obviously registers the frame with the selected work pallet 40.

At this point, the clamp screws 86 on the frame holder support 84 are tightened to firmly clamp the screen frame 70 to the support and thereby secure the frame in its registered position. The registration pins 114 are then removed, and the selected work pallet and pallet attachment tool are lowered and rotated to the next print station 28 where the above registration procedure is repeated. An important advantage of the present registration means resides in the fact that the registration holes 116, 118 are located at the front of each print head 58 where they are easily accessible for insertion and removal of the registration pins 114.

After all of the screen frames 70 have been registered in the manner described above, the printer is conditioned for normal printing operation by removing at least the front part 99 of the pallet attachment tool 88 from the selected work pallet 40. The pallet attachment tool mounting block 98 may be left on the selected pallet to facilitate later registration of the printer. A work piece W to be printed is fixed to the upper side of each work pallet 40 in proper alignment or registration with the pallet. The work pieces are secured to the pallets in any convenient way. The printer 20 is then operated in its normal printing mode to imprint the printing screen images on the work pieces in succession to produce a composite multicolor image on each work piece.

The image on each printing screen 72 is registered with, that is located in a predetermined position relative to, its screen frame 70 and, more importantly, relative to the frame registration holes 116 which provide registration references on the frame. This registration of each screen image with its frame registration holes may be accomplished in any convenient way, as by utilizing, in the manner explained earlier, a vacuum table having registration pins engagable in the frame registration holes 116. Each work piece W is registered or aligned with its work pallet in the same way as in a conventional carousel printer. The registration holes 118 in the pallet attachment tool 88 provide registration references and are situated on the pallet attachment tool in positions such that when these registration holes are aligned with the registration holes 116 in a screen frame 70, the image on the printing screen mounted on the frame is precisely registered or aligned with a work piece fixed in the proper registered position on the selected pallet. Since all of the work pallets 40 occupy identical, though circumferentially spaced, positions on the turret 24, registration of each screen image with the selected work pallet in the manner explained above is effective to precisely register each screen image with all of the work pallets and hence with the work pieces on all the pallets.

Figure 13:
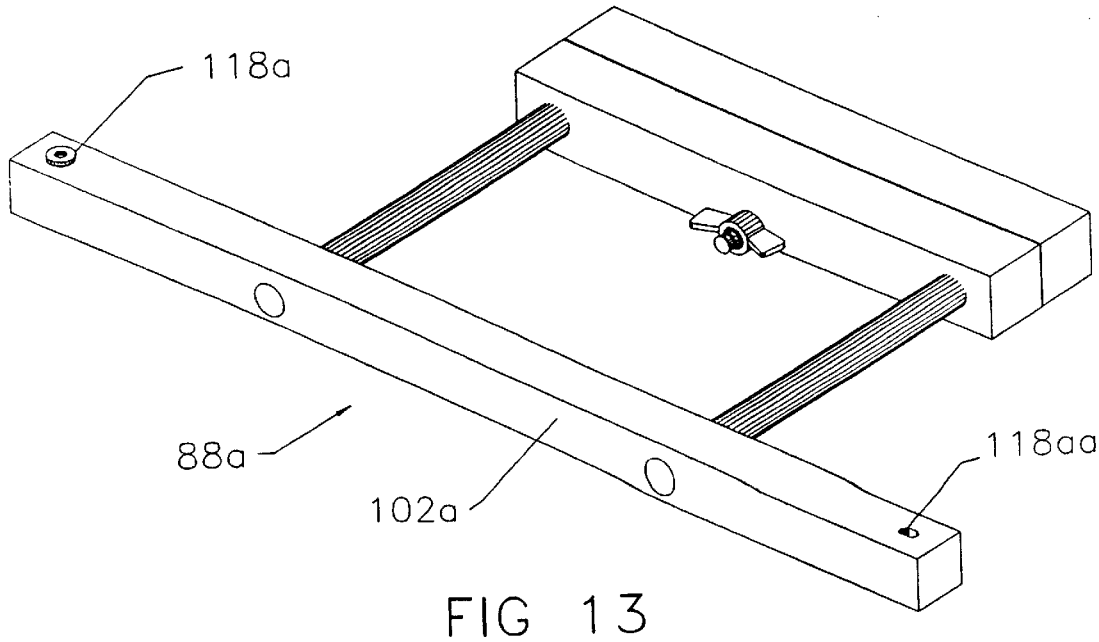
FIGS. 13 and 14 illustrate two modified pallet attachment tools according to the invention.
Figure 14:
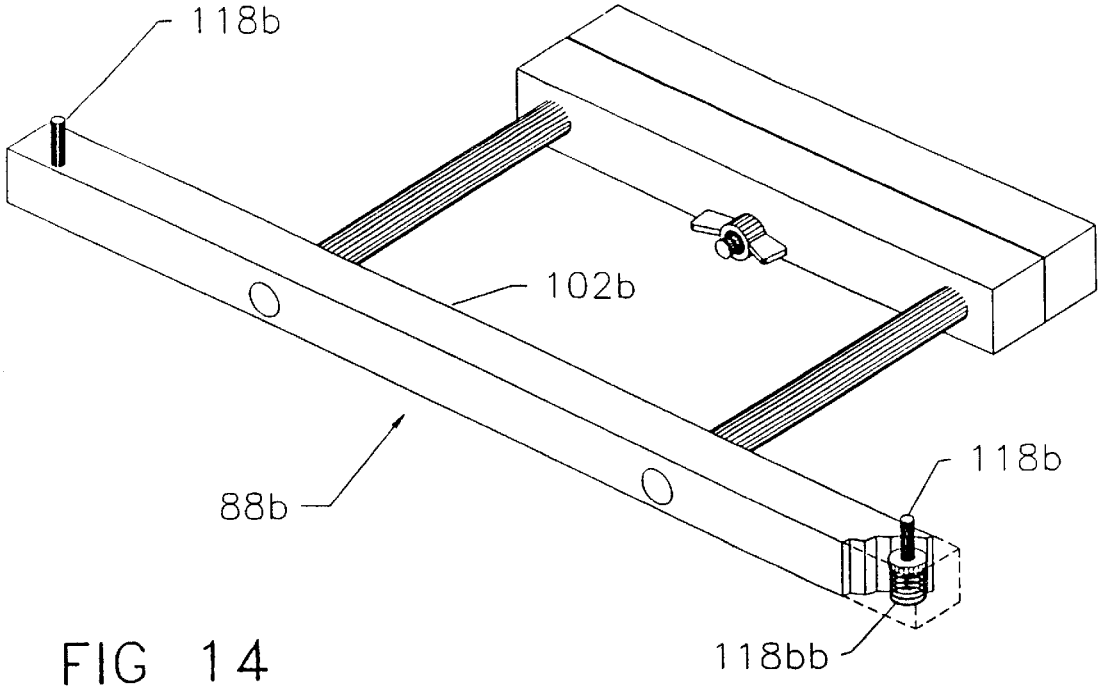

FIGS. 13 and 14 illustrate modified pallet attachment tools 88*a*, 88*b* each of which may be used in place of the pallet attachment tool 88. The modified pallet attachment tools are identical to the pallet attachment tool 88 except in the following respects. The front bar 102*a* of the pallet attachment tool 88*a* has a circular registration hole 118*a* and an elongated registration hole 118*aa*. The circular registration hole 118*a* is sized to slidably receive a registration pin 114, as in the pallet attachment tool 88. The elongated registration hole 118*aa* is sized in width transverse to the front bar 102*a* to slidably receive a registration pin 114 and is elongated lengthwise of the front bar to accommodate a range of spacings between the registration holes 116 on the screen frames 70. The modified pallet attachment tool 88*a* is used in the same manner as the pallet attachment tool 88.

The front bar 102*b* of the pallet attachment tool 88*b* of FIG. 14 has a pair of upstanding registration pins 118*b* in place of and located at the same positions as the registration holes 118 in the front attachment bar 102 of attachment 88. These registration pins could be rigidly joined to the front bar 102*b*. Preferably, however, the pins 118*b* are axially slidable in the front bar and are resiliently urged outwardlyby springs 118*bb*. The modified pallet attachment tool 88*b* is used in much the same way as the pallet attachment tool 88 except that registration pins 114 are not used, and during registration, each screen frame 70 is adjusted edgewise in its support 84 until the pallet attachment tool pins 118*b* engage in the frame registration holes 114.

Figure 15:
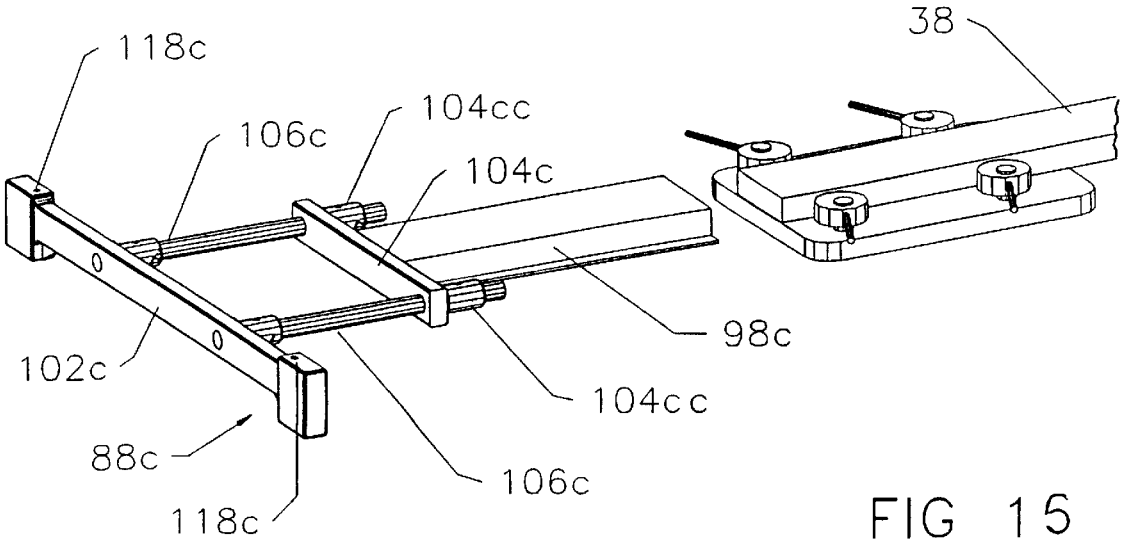
FIG. 15 illustrates a pallet replacement tool according to the invention which may be used in place of the pallet attachment tools of FIGS. 7, 8, 13, and 14.
Figure 16:
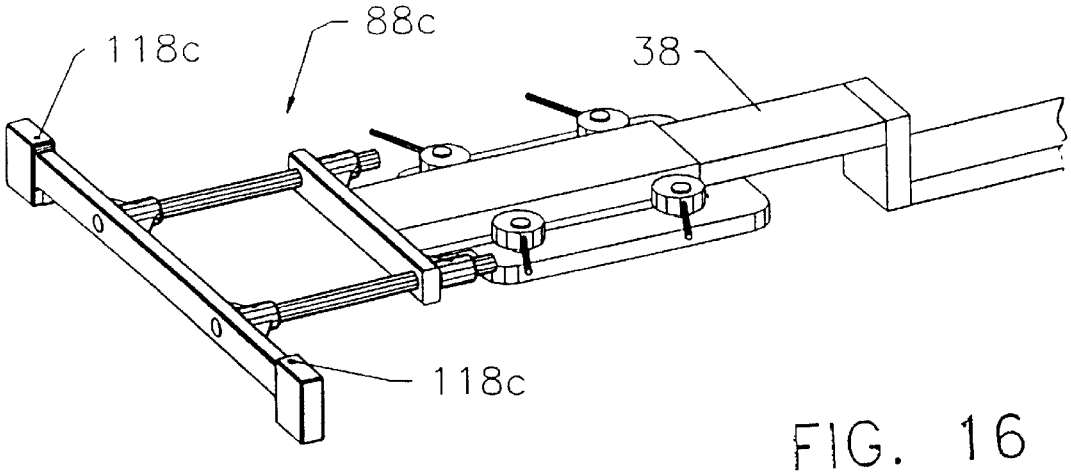
FIG. 16 illustrates the pallet replacement tool of FIG. 15 mounted on a work support of the printer.
Figure 17:
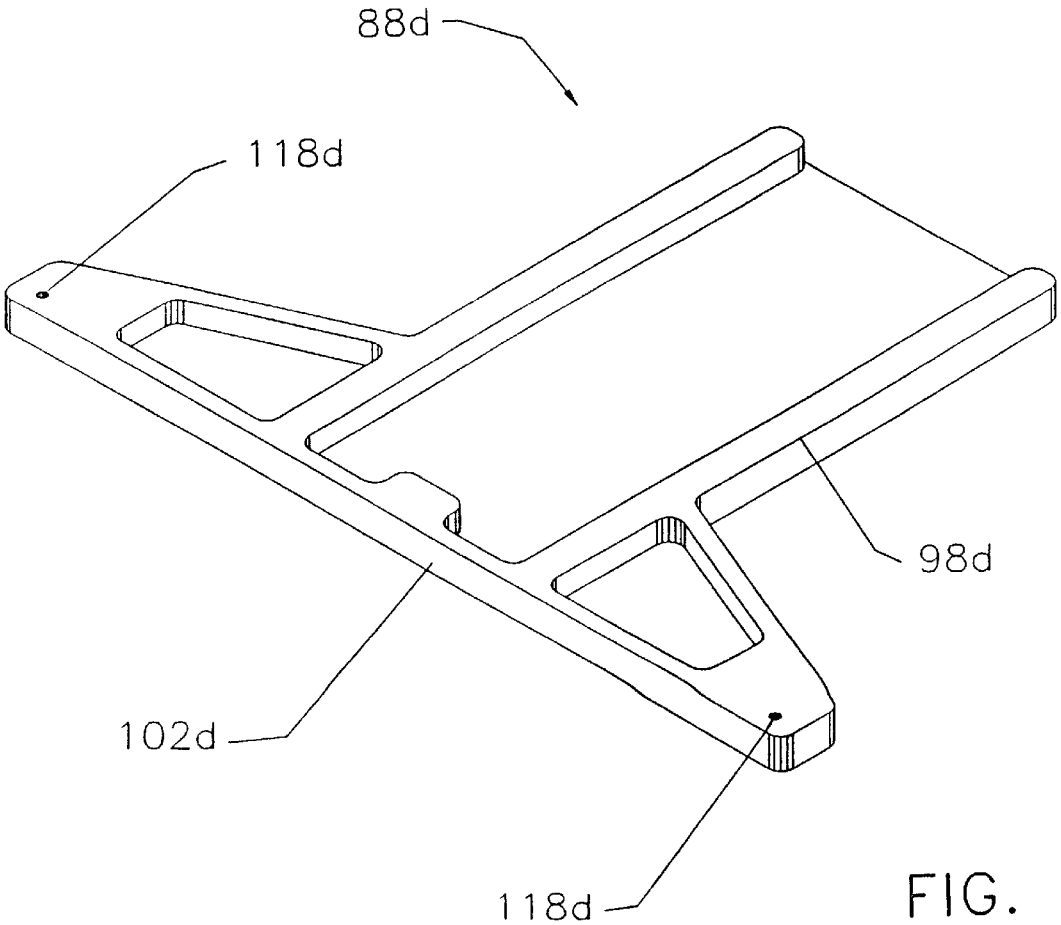
FIG. 17 illustrates a modified pallet replacement tool according to the invention.

FIGS. 15–17 illustrate pallet replacement tools 88*c* and 88*d* according to the invention which may be used in the registration means 82 of the invention in place of the pallet attachment tools described to this point. The pallet replacement tool 88*c* comprises front and rear bars 102*c*, 104*c* rigidly joined by connecting rods 106*c*. The rear bar 104*c* may be adjustable on the rods 106*c* to adjust the spacing between the bars 102*c*, 104*c* and secured in position by means 104*cc* on the rear bar. Rigidly joined to the rear side of the rear bar 104*c* midway between its ends and extending rearwardly from the rear bar is a channel 98*c* to be secured to a pallet support arm 38 in the same manner as the channels 44 on the printer work pallets 40. The pallet replacement tool 88*c* is adapted to be mounted on a selected pallet support arm 38 of the printer turret 24 in place of the work pallet 40 on the arm, as shown in FIG. 16. The front bar 102*c* of the pallet replacement tool 88*c* has registration holes 118*c*.

The pallet replacement tool 88*c* is used in essentially the same way as the pallet attachment tool 88 to register the printer screen frames 70 during operation of the printer in its registration mode. Thus, during registration, the pallet attachment tool is rotated to the print stations 28 in succession and elevated at each station into close proximity to or contact with the respective screen frame. The frame is then adjusted to align its registration holes 116 with the registration holes 118*c* in the pallet attachment tool and thereby permit insertion of the registration pins 114 through the aligned holes. The remainder of the registration procedure and normal printer operation are the same as described earlier.

The pallet replacement tool 88*d* of FIG. 17 comprises a one piece casting including a front bar portion 102*d* and a rear channel portion 98*d*. In the ends of the front bar portion 102*d* are registration holes 118*d*. The pallet attachment tool 88*d* is adapted to be mounted on a pallet support arm 38 of the printer turret 24 in the same manner as the pallet replacement tool 88*c* and is used in the same way as the tool 88*d* to register the printer screen frames 70.

Thus there has been shown and described a novel pin registration system for screen printing which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. In a screen printing apparatus comprising (A) a print head including a screen frame mounting a printing screen bearing a screen image to be printed, a screen frame support removably supporting said frame for edgewise adjustment of said frame relative to said print head, and frame securing mechanism for releasably securing said frame in fixed position relative to said print head, (B) a work support comprising a work pallet for supporting a work piece to be printed, and (C) mechanism for effecting relative movement of said frame support and said work support to and from a printing position wherein said work support is aligned with said print head and is disposed in printing relation to said screen frame, the improvements comprising:

a registration mechanism for registering said frame directly to said work support when said frame is released for edgewise adjustment relative to said print head and said work support is located in a registration position wherein the work support is aligned with said print head, and wherein said registration mechanism comprises a device on said work pallet, and an alignment device directly engagable between said screen frame and said registration device for aligning said frame in a predetermined registered position relative to said registration device wherein said frame occupies a certain position relative to said print head and said frame occupies a predetermined registered position relative to said work support when said work support occupies said printing position, and said frame securing mechanism is operative to secure said frame in said certain position relative to said print head.

2. The subject matter of claim 1, wherein:

said work support comprises a work pallet for receiving the workpiece to be printed, and said registration device comprises a pallet attachment tool including a first part secured to said pallet, a second part removably secured to said first part, said alignment device being directly engagable between said screen frame and said second part of said pallet attachment tool.

3. A registration device for a screen printer having a base and a work support mounted on said base, said registration device comprising:

a registration member having normally front and rear portions, a mounting mechanism on said registration member on one of the front and rear portions for removably mounting the member on the printer work support, and registration features at the other of said front and rear portions of said registration member and extending beyond the perimetric edge of the work support, said registration features comprising one of the following: (A) a pair of registration holes opening through said upper side of said member and spaced laterally on the member, (B) a pair of registration pins spaced laterally on said member and extending above said upper side of the member.

4. In a screen printing machine comprising (A) a plurality of print heads each including a screen frame mounting a printing screen bearing a screen image to be printed, a screen frame support for removably receiving said screen frame and supporting said frame for edgewise adjustment of said frame relative to the respective print head, and frame securing mechanism for releasably securing said frame in fixed position relative to the respective print head, (B) work supports for supporting work pieces to be printed, and (C) a system for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

a registration device for registering said screen frames to said work supports by registering each screen frame directly to a selected work support when the respective frame is released for edgewise adjustment relative to the corresponding print head, and the selected work support is aligned with and occupies a certain registration position relative to the corresponding print head, and wherein said registration device is on said selected work support, and alignment features directly engagable between each screen frame and said registration device when said selected work support occupies said registration position at the corresponding print head for aligning the respective frame in a predetermined registered position relative to said registration device wherein the respective frame occupies a certain position relative to the corresponding print head and the respective frame occupies a predetermined registered position relative to each work support located in said printing position relative to the respective print head, and said frame securing mechanism of each print head are operative to secure the corresponding screen frame in said certain position relative to the respective print head.

5. A registration device for a screen printer having a work support comprising:

a registration member including two separable parts, said parts being adapted to be releasably and rigidly joined in rigidly fixed assembled relation relative to one another, said one part being adapted to be mounted on the printer work support in rigidly fixed relation to the work support, and registration features on a portion of said one part and extending beyond a perimetric edge of the one part, said registration features comprising one of the following: (A) a pair of spaced registration holes opening through said upper side of said other part, (B) a pair of spaced registration pins extending above said upper side of said other part.

6. A registration device for a screen printer having a work support comprising:

a registration mechanism including two separable parts having normally upper and lower sides, said parts being releasably joined, one of said parts being mountable on the printer work support, registration features on the other part comprising one of the following: (A) a pair of spaced registration holes opening through said upper side of said other part, (B) a pair of spaced registration pins extending above said upper side of said other part, a work pallet having an upper side for receiving a workpiece to be printed, a lower side, and a perimetric edge, the work pallet being mountable on said printer work support, and wherein said one part is removably mounted on said lower side of said pallet with said registration features located beyond said perimetric edge of the pallet.

7. A registration device according to claim 6, wherein:

said printer work support comprises one arm of a plurality of radially arrayed arms of the screen printer, and the said one of said parts comprises a work support pallet.

8. A registration system for a screen printer machine having a work support, comprising:

a registration member including two separable parts having normally upper and lower sides, said parts being releasably joined, a first one of said parts being removably mounted on the printer work support, the printer work support including an arm extending from a central portion of the screen printer machine, registration features on a second of said parts comprising one of the following: (a) a pair of spaced registration holes, (b) a pair of spaced registration pins, said first one of said parts having an upper side for receiving a workpiece to be printed, a lower side, and a perimetric edge, and being mountable on said printer work support, and wherein said first one of said parts comprises a device thereon for removably receiving said work support arm with said registration features thereon disposed beyond said perimetric edge of said first one of said parts.

9. In a screen printing machine comprising (a) a plurality of print heads each including a screen frame mounting a printing screen bearing a screen image to be printed, a screen frame support for removably receiving said screen frame and supporting said frame for adjustment of said frame relative to the respective print head, said frame being releasably secured in fixed position relative to the respective print head, (b) work support apparatus including a plurality of work supports for supporting work pieces to be printed, respective work supports disposed on respective arms extending in radially spaced relation outwardly of the machine, and (c) mechanism for relatively moving said print heads and said work supports to align the work supports with the print heads in succession and effect relative movement of the work supports to successive printing positions wherein each work support is aligned with a print head and is disposed in printing relation to the screen frame of the respective print head, the improvements comprising:

registration apparatus for registering said screen frames to said work supports by registering each screen frame directly to a selected work support when the respective frame is released for edgewise adjustment relative to the corresponding print head, and the selected work support is aligned with and occupies a registration position relative to the corresponding print head, and wherein said registration apparatus comprises alignment components attached to the selected work support and adapted to receive a respective one of said machine arms for alignment of the work support pallet relative to the arm and said registration apparatus further comprises mechanism on said work support and extending beyond the periphery of the work support to position registration features thereof for engagement with cooperating registration features on the screen frame for registration of the work support with the screen frame when said selected work support occupies said registration position at the corresponding print head.

* * * * *